US006625934B1

(12) United States Patent
McGrath, III

(10) Patent No.: US 6,625,934 B1
(45) Date of Patent: Sep. 30, 2003

(54) METHOD FOR MONITORING ENVIRONMENTAL CONDITIONS IN RESTRICTED SPACES

(76) Inventor: James J. McGrath, III, 23328 Inspiration Lake Dr., Menifee, CA (US) 92584

( * ) Notice: Subject to any disclaimer, the term of this patent is extended or adjusted under 35 U.S.C. 154(b) by 0 days.

(21) Appl. No.: 09/479,393

(22) Filed: Jan. 6, 2000

(51) Int. Cl.[7] ..... E04H 14/00

(52) U.S. Cl. ..... 52/27; 52/30; 52/173.1; 52/220.1; 220/3.6; 220/62.11; 220/62.13; 187/1; 187/29; 187/280; 187/391; 187/393; 187/279; 187/316; 187/317; 119/452; 119/453; 119/482; 119/484

(58) Field of Search ..... 52/27, 30, 173.1, 52/220.1; 220/3.6, 62.11, 62.13; 187/29, 1, 391, 393, 280, 279, 316, 317; 312/242, 111, 114; 119/452 B, 453, 482, 484

(56) References Cited

U.S. PATENT DOCUMENTS 1,509,285 A * 9/1924 Colbow ..... 109/54
2,612,283 A * 9/1952 Cole ..... 220/3.6
3,707,818 A * 1/1973 Nelsson ..... 52/220.1
3,738,322 A * 6/1973 Smith ..... 119/484
3,788,428 A * 1/1974 Fried ..... 187/29
3,822,925 A * 7/1974 Osroff ..... 312/242
4,021,975 A * 5/1977 Calkins ..... 52/64
4,023,146 A * 5/1977 Carroll ..... 340/172.5
4,224,899 A * 9/1980 Cruchelow et al. ..... 119/501
4,434,516 A * 3/1984 Morris et al. ..... 4/252.2
4,592,270 A * 6/1986 Vener ..... 98/39.1
4,788,934 A * 12/1988 Fetter ..... 119/484
4,944,216 A * 7/1990 McCutchen ..... 98/33.1
4,989,546 A * 2/1991 Cannaday ..... 119/484
5,016,715 A * 5/1991 Alasio ..... 169/61
5,134,969 A * 8/1992 Mason et al. ..... 119/472
5,171,079 A * 12/1992 Bayerle ..... 312/409
5,261,350 A * 11/1993 Vavrek ..... 119/484
5,522,344 A * 6/1996 Demurjian ..... 119/474
5,644,111 A * 7/1997 Cerny et al. ..... 187/393
5,649,500 A * 7/1997 Klavemann et al. ..... 119/452
5,718,627 A * 2/1998 Wicks ..... 454/68
5,826,545 A * 10/1998 Steffes et al. ..... 119/473
6,336,523 B1 * 1/2002 Ozeki et al. ..... 187/391
6,394,035 B1 * 5/2002 Hill ..... 119/484
2002/0144659 A1 * 10/2002 Sinor ..... 119/484

* cited by examiner

*Primary Examiner*—Carl D. Friedman
*Assistant Examiner*—Christy M. Green
(74) *Attorney, Agent, or Firm*—Stout, Uxa, Buyan & Mullins, LLP; Donald E. Stout

(57) ABSTRACT

An environmental detection system is particularly suited for elevator hoistways and other locations where access is difficult or restricted. The inventive system comprises a fire rated access cage which is disposed within the hoistway in a desired location, and is securely attached to an associated access panel, which is fire protection rated and positioned to extend through a wall defining the hoistway. An environmental sensing device, such as a smoke detector or heat sensor, is secured within the cage so that it is disposed within the hoistway, and can freely detect any smoke or excessive heat present in the hoistway because of a large number of apertures in the walls of the cage. The resultant system, thus, is constructed so that authorized personnel can access the environmental sensing unit conveniently through the access panel door from an adjacent hallway or room to test or maintain it, without shutting down the associated elevator or compromising the effectiveness of the unit.

5 Claims, 2 Drawing Sheets

METHOD FOR MONITORING ENVIRONMENTAL CONDITIONS IN RESTRICTED SPACES

BACKGROUND OF THE INVENTION

This invention relates to methods and apparatus for monitoring environmental conditions in restricted spaces, and more particularly to methods and apparatus for monitoring elevator hoistways for fire or smoke, and which provide convenient access for maintenance purposes without the need to take the associated elevator out of service.

Larger buildings, typically commercial and public buildings having multiple floors or stories, also include one or more elevators for providing convenient access to each floor without having to climb stairs. These elevators traverse a vertical shaft or hoistway in the building, either on a hydraulic lift or on a cable. For the safety of building occupants, particularly because elevators and their associated machinery present a significant fire danger, fire codes require that these hoistways be monitored for environmental conditions such as fire and smoke, by the placement of one or more environmental sensing units, such as smoke detectors and/or heat sensors, within each hoistway. The hoistway is also to be enclosed by fire protection rated walls in the event of a fire therein, in order to give building occupants sufficient time to exit the building safely.

In order to ensure the continued operability of these environmental sensing devices or units, fire codes require that they be inspected and tested periodically. The inspection and testing procedure typically involves shutting down the associated elevator, so that maintenance and/or fire department personnel can enter the hoistway and physically inspect and test the device. Such a procedure is time consuming and inconvenient, both for the personnel performing the procedure and for the building occupants, who must tolerate the reduced elevator service available from the remaining elevators in the building, or take the stairs.

What is needed, therefore, is an environmental monitoring system for elevator hoistways which permits an appropriate number of environmental sensing units to be placed in each hoistway, in desired locations for acceptable coverage thereof, but which also permits servicing and testing personnel to access those units whenever desired, without the need to enter the hoistway and thereby necessitate shutting down the associated elevator.

SUMMARY OF THE INVENTION

The present invention solves the aforementioned problems by providing an environmental monitoring system which is particularly suited for elevator hoistways and other locations where access is difficult or restricted. The invention comprises a fire rated access cage which is disposed within the hoistway in a desired location, and is securely attached to an associated access panel. The access panel is fire protection rated and positioned to extend through a wall defining the hoistway. An environmental sensing device, preferably a smoke detector, but alternatively a heat sensor or other suitable device, is secured within the cage so that it is disposed within the hoistway, and can freely detect negative environmental conditions, such as heat or smoke, present in the hoistway because of a large number of apertures in the walls of the cage. The resultant system is thus constructed so that authorized personnel can access the environmental sensing unit conveniently through the access panel door from an adjacent hallway or room to test or maintain it, without shutting down the associated elevator or compromising the effectiveness of the unit.

More particularly, there is provided an apparatus for use in monitoring spaces affording restricted access, which comprises an access panel including a door and a cage attached to the access panel. The cage has a plurality of openings or apertures for ensuring fluid communication between an interior portion of the cage and a surrounding space. Preferably, these apertures are present because the cage comprises expanded metal. An environmental sensing unit, such as a smoke detector or heat sensor, is secured within the interior of the cage. As a result, when the cage is installed, the smoke detector resides within the space affording restricted access, preferably an elevator hoistway, within an interior portion of the cage. The cage is preferably welded to the access panel, which further includes a frame, with the cage being welded to the frame.

In another aspect of the invention, there is disclosed a method for monitoring environmental conditions in a space affording restricted access. The method comprises steps of placing an access enclosure through an opening in a wall adjacent to the space, wherein the access enclosure comprises an access panel including a door and a cage attached to the access panel. The cage has a plurality of openings for ensuring fluid communication between an interior portion of the cage and a surrounding space. Further steps include disposing an environmental sensing device within the interior portion of the cage and opening the door to inspect or test the device.

In still another aspect of the invention, there is disclosed a method for monitoring environmental conditions in a space affording restricted access, preferably an elevator hoistway, without entering the space. The method comprises the steps of opening a door in an access enclosure from a second space adjacent to the restricted access space, and inspecting or testing an environmental sensing device disposed in the access enclosure. The method preferably includes a further step of maintaining normal operations in the restricted space while the inspecting or testing step is performed.

The invention, together with additional features and advantages thereof, may best be understood by reference to the following description taken in conjunction with the accompanying illustrative drawing.

DESCRIPTION OF THE PREFERRED EMBODIMENT

Figure 1:
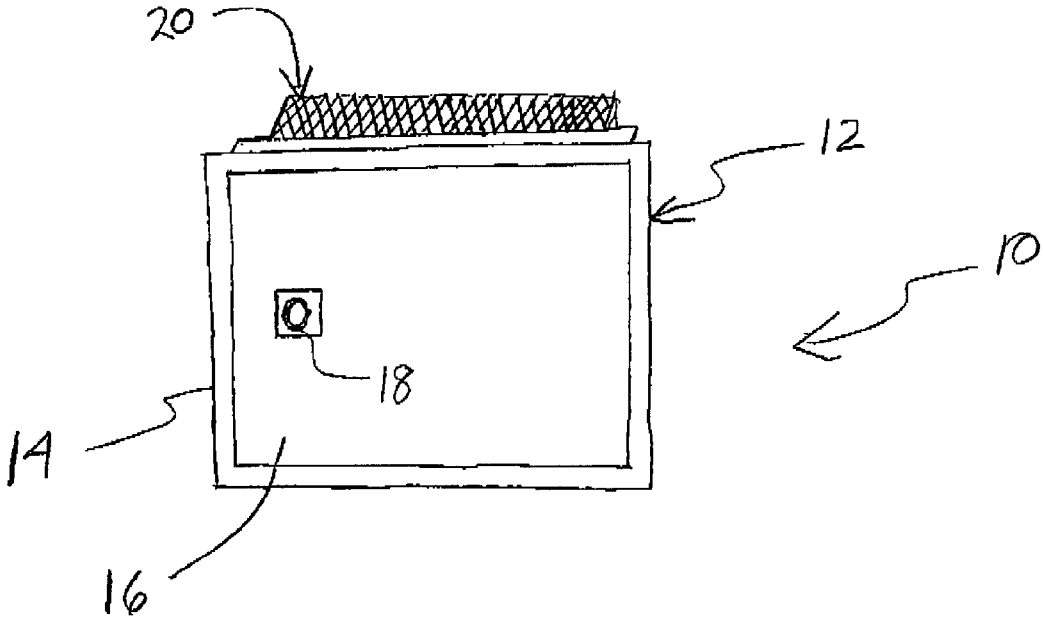
FIG. 1 is a frontal perspective view of an environmental monitoring system access enclosure constructed in accordance with the principles of the present invention.
Figure 2:
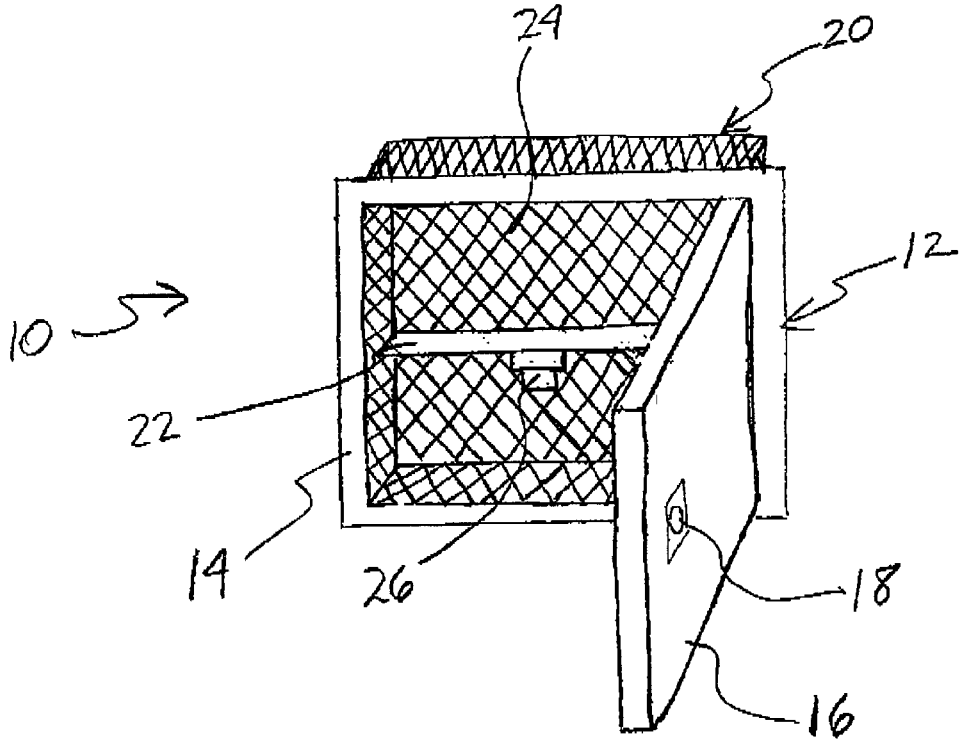
FIG. 2 is a frontal perspective view similar to FIG. 1, illustrating the inventive environmental monitoring system access enclosure in an open configuration, whereby the environmental monitoring unit disposed therein is visible.

Referring now more particularly to the drawings, there is shown in FIGS. 1 and 2 an environmental monitoring sensor access enclosure 10 which is constructed in accordance with the teachings of the present invention. The enclosure 10 comprises an access panel portion 12, preferably of a type which is commercially available, for example, from JJ Industries, Inc. of Bloomington, Minn., and is commonly referenced as an access frame and fire door assembly. The access panel portion comprises a frame member 14 on which is hung an access door 16, by means of hinges or the like (not shown) so that it may be opened and secured in a standard fashion. A handle 18 is provided for this purpose. This type of access frame and fire door assembly is typically used in a fire-rated wall in a commercial or public building to provide convenient access to utility components of various types through the wall without compromising its fire protection rating. Such components may includes sprinkler or water valves, electrical subpanels, switches, and the like, by way of example.

In a preferred embodiment of the invention, the access panel portion 12 is rated to provide 1 ½ hours of fire protection. Welded or otherwise securely attached to the frame member 14 is an expanded metal cage 20. A significant feature of the invention is the use of an open cage 20 of this type in conjunction with the access panel portion 12, for reasons to be described below. Of course, while expanded metal is the preferred material, other suitable materials which provide adequate access between the interior and the exterior of the cage 20 may be employed as well.

Though not required, it is preferred that a shelf 22 be disposed within the interior of the cage 20, as shown in FIG. 2. Preferably, the shelf is comprised of solid metal, as shown, but may also be comprised of expanded metal, or of other suitable material, and may be welded into the interior of the cage by attachment to the walls thereof. Alternatively, if desired, the shelf may be secured within the cage interior so that its position is adjustable. By way of example, in preferred embodiments of the invention, the cage 20 is 18 inches wide, 18 inches high, and 12 inches deep. The shelf 22 is disposed approximately 9 inches from both the top and bottom walls of the cage 20; i.e. at the halfway point along the height of the back wall 24 of the cage, and extends outwardly approximately 3 inches from the back wall 24 of the cage 20. Of course, any suitable sizes may be utilized depending upon particular desired application. The purpose for the shelf 22 is to provide a suitable mounting point for an environmental sensing device 26 (FIG. 2), which is preferably secured to a bottom side of the shelf 22 by any suitable means, such as wire hangers, for example. Preferably, the device or unit 26 comprises a smoke detector, but it may also comprise, for example, a hit sensor for sensing heat, rather than smoke.

Figure 3:
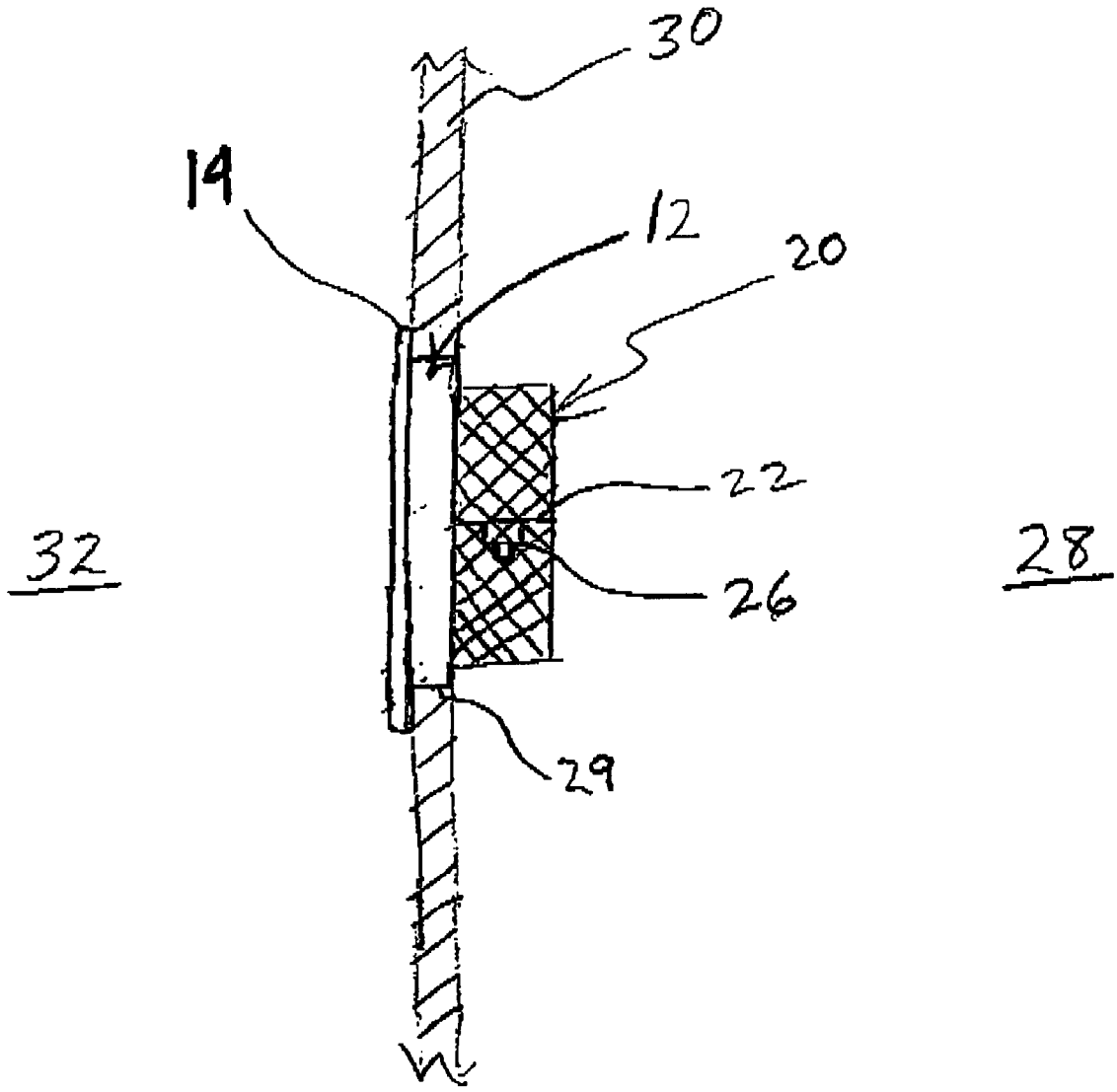
FIG. 3 is a cross-sectional side view of the environmental monitoring system access enclosure of FIGS. 1 and 2, wherein it has been installed through a structure wall in accordance with the principles of the present invention.

In operation, as shown particularly in FIG. 3, when it is desired to provide environmental monitoring of an elevator hoistway or shaft 28, a suitable opening 29 is created in a fire-rated wall 30 adjacent to the hoistway 28, between the hoistway and an adjacent corridor or room 32. The access panel portion 12 is installed into the opening 29 in a secure and fire-tight manner, as is well known in the art of the installation of fire-rated access panels, so that the fire protection rating of the wall is not compromised. When properly installed, the cage 20 will extend outwardly into the hoistway 28, as shown in FIG. 3. Thus, when the environmental sensing device 26 is operational, it is positioned directly in the hoistway in order to enable detection of smoke and/or heat within the hoistway, in accordance with fire codes and regulations.

With the inventive installation, maintenance or fire personnel can maintain or assess the operability of a sensor 26 which monitors an elevator hoistway 28, merely by opening the access door 16 of the enclosure 10. This permits access to the sensor 26 from an easily accessible hallway or room 32, avoiding the need to shut down the associated elevator and gain access to the sensor directly through the elevator hoistway.

Of course, while elevator shaft installations are the intended environment for the inventive apparatus, other installations are appropriate as well, such as spaces having restricted access, wherein it is desired to have a capability to maintain the operability of environmental monitoring sensors monitoring the space without the necessity of entering the space. Additionally, while in the preferred embodiment one such monitoring device is disclosed for disposition in each access cage, it is within the scope of this invention to position as many devices, of the same or different types, in each cage as is desired for a particular application. The inventive concept is also applicable to use with other types of monitoring devices as well, such as carbon monoxide detectors, thermometers, humidity sensors, video cameras, audio detectors, or the like.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A method for monitoring environmental conditions in an elevator hoistway, comprising:

placing an access enclosure through an opening in a wall adjacent to said elevator hoistway, the access enclosure comprising an access panel including a door and a cage attached to said access panel, said cage having a plurality of openings for ensuring fluid communication between an interior portion of the cage and said elevator hoistway, said cage being disposed in said elevator hoistway so that said elevator hoistway surrounds said cage;

disposing an environmental sensing device, for sensing environmental conditions in said elevator hoistway, within said interior portion of the cage; and opening said door to inspect or test said environmental sensing device.

2. The method as recited in claim 1, wherein the step of disposing the environmental sensing device within the interior portion of the cage includes a further step of securing the environmental sensing device to a shelf within said interior portion.

3. The method as recited in claim 2, wherein the step of securing the environmental sensing device to said shelf includes a step of attaching the environmental sensing device to an underneath surface of the shelf.

4. The method as recited in claim 1, comprising the further step of maintaining normal operations in said elevator hoistway while the inspecting step is being performed.

5. The method as recited in claim 4, wherein said normal operations comprise continued operation of an elevator disposed within said elevator hoistway.

* * * * *

UNITED STATES PATENT AND TRADEMARK OFFICE

CERTIFICATE OF CORRECTION

PATENT NO. : 6,625,934 B1
DATED : September 30, 2003
INVENTOR(S) : James J. McGrath, III It is certified that error appears in the above-identified patent and that said Letters Patent is hereby corrected as shown below:

Column 3,
Line 4, after "portion", add -- 12 --.
Line 46, after "a", change "hit" to -- heat --.

Signed and Sealed this

Sixth Day of July, 2004

JON W. DUDAS
*Acting Director of the United States Patent and Trademark Office*